US005643021A

United States Patent [19]

Osakabe

[11] Patent Number: 5,643,021

[45] Date of Patent: Jul. 1, 1997

[54] TRIM SYSTEM FOR OUTBOARD MOTOR

[75] Inventor: Takayuki Osakabe, Hamamatsu, Japan

[73] Assignee: Sanshin Kogyo Kabushiki Kaisha, Hamamatsu, Japan

[21] Appl. No.: 363,745

[22] Filed: Dec. 23, 1994

[30] Foreign Application Priority Data

Dec. 30, 1993 [JP] Japan ..... 5-354046

[51] Int. Cl.[6] ..... B63H 5/12

[52] U.S. Cl. ..... 440/61

[58] Field of Search ..... 440/53, 61, 900; 91/405, 407, 409, 404; 92/85 B, 143; 137/514.5; 251/332

[56] References Cited

U.S. PATENT DOCUMENTS 3,034,482 5/1962 Rader ..... 91/405

3,093,117 6/1963 Brown ..... 91/405

3,213,760 10/1965 Carr ..... 92/85 B 3,844,247 10/1974 Collis et al. ..... 440/61

5,065,790 11/1991 Kornas ..... 137/514.5

*Primary Examiner*—Edwin L. Swinehart

*Attorney, Agent, or Firm*—Knobbe, Martens, Olson & Bear LLP

[57] ABSTRACT

A hydraulic tilt and trim mechanism for a marine outboard drive wherein the trim cylinder is provided with a valve element that is positioned responsive and which defines a fluid lock when the piston is in a trimmed down position for providing hydraulic resistance to further trim-down operations so as to minimize noise and wear. A mechanical stop is also provided within the trim cylinder.

5 Claims, 5 Drawing Sheets

TRIM SYSTEM FOR OUTBOARD MOTOR

BACKGROUND OF THE INVENTION

This invention relates to a trim system for an outboard motor and more particularly to an improved trim system for a marine outboard drive.

As is well known, it is a common practice to mount marine outboard propulsion systems such as an outboard motor or the outboard drive portion of an inboard/outboard drive on the hull of a watercraft for trim adjustment of the propulsion unit relative to the hull. It has been found that the optimum trim position of the outboard drive, and specifically its propulsion unit relative to the hull, is important in determining the performance of the watercraft. Frequently, the trim is adjusted during operation of the watercraft so as to accommodate the specific running conditions.

Normally, the trim adjustment for a marine outboard drive is provided by a hydraulic trim motor that is interposed between the hull and the outboard drive. By selectively pressurizing the chamber of the fluid motor, it is possible to effect a force between the hull and the outboard drive for moving the outboard drive to the desired trim position. In order to permit trim-down adjustment, the foregoing description being that of a trim-up adjustment, it is normally the practice to depressurize the chamber and permit the propulsion unit to trim down under its own propulsion force.

Although these devices are particularly advantageous, they do have one disadvantage. That is, when the outboard drive is in a relatively fully trimmed down condition, there is a danger that the components of the hydraulic motor can contact each other, cause noise, and cause wear. This is because there is, at best, a mechanical stop that limits the trimmed down position. The stop may be effected be actual engagement between the piston and cylinder of the trim motor. This gives rise to the aforenoted problems.

It is, therefore, a principal object of this invention to provide an improved trim adjustment mechanism for a marine outboard drive.

It is a further object of this invention to provide a trim motor for a marine outboard drive that has an arrangement for providing a stop for limiting or controlling the trimmed down condition without affecting actual mechanical engagement between the components of the trim motor.

It is a further object of this invention to provide a trim motor for trim adjustment of a marine outboard drive wherein a hydraulic lock is established to control the trimmed down position and avoid reduce metal-to-metal contact between the major components of the trim motor.

In order to protect the piston and cylinder from direct engagement, it has been proposed to provide a stop that will limit their degree of relative movement in the trim down condition. However, these stops have been provided externally of the cylinder mechanism and thus have certain possible defects. First, due to misadjustment or operator modification, they may become ineffective and thus the piston and cylinder are subject to wear. In addition, the exposed position of the external stop places it in an area where it can be damaged.

It is, therefore, a still further object to this invention to provide an improved trim down stop mechanism for a hydraulic trim cylinder that is contained internally within the cylinder.

SUMMARY OF THE INVENTION

This invention is adapted to be embodied in a hydraulic trim adjusting mechanism for a marine outboard drive having a propulsion unit mounted on a watercraft hull for movement relative to the hull through a plurality of trim adjusted positions for adjusting the trim of the propulsion unit relative to the hull. A hydraulic trim motor is interposed between the propulsion unit and the hull for effecting hydraulic trim adjustment. The hydraulic trim motor is comprised of a pair of relatively movable components that define a fluid chamber. A hydraulic system is provided for selectively pressurizing and depressurizing the fluid chamber for effecting trim adjustment.

In accordance with a first feature of the invention, position responsive valve means cooperate between the relatively movable components for isolating the chamber from the hydraulic system when the components are in a trimmed down condition, for establishing a fluid lock within the chamber and for reducing direct engagement between the components while limiting the trimmed down position.

In accordance with another feature of the invention, stop means are interposed in the fluid chamber between the members for limiting their degree of movement in the trim down direction.

DETAILED DESCRIPTION OF THE PREFERRED EMBODIMENT OF THE INVENTION

Figure 1:
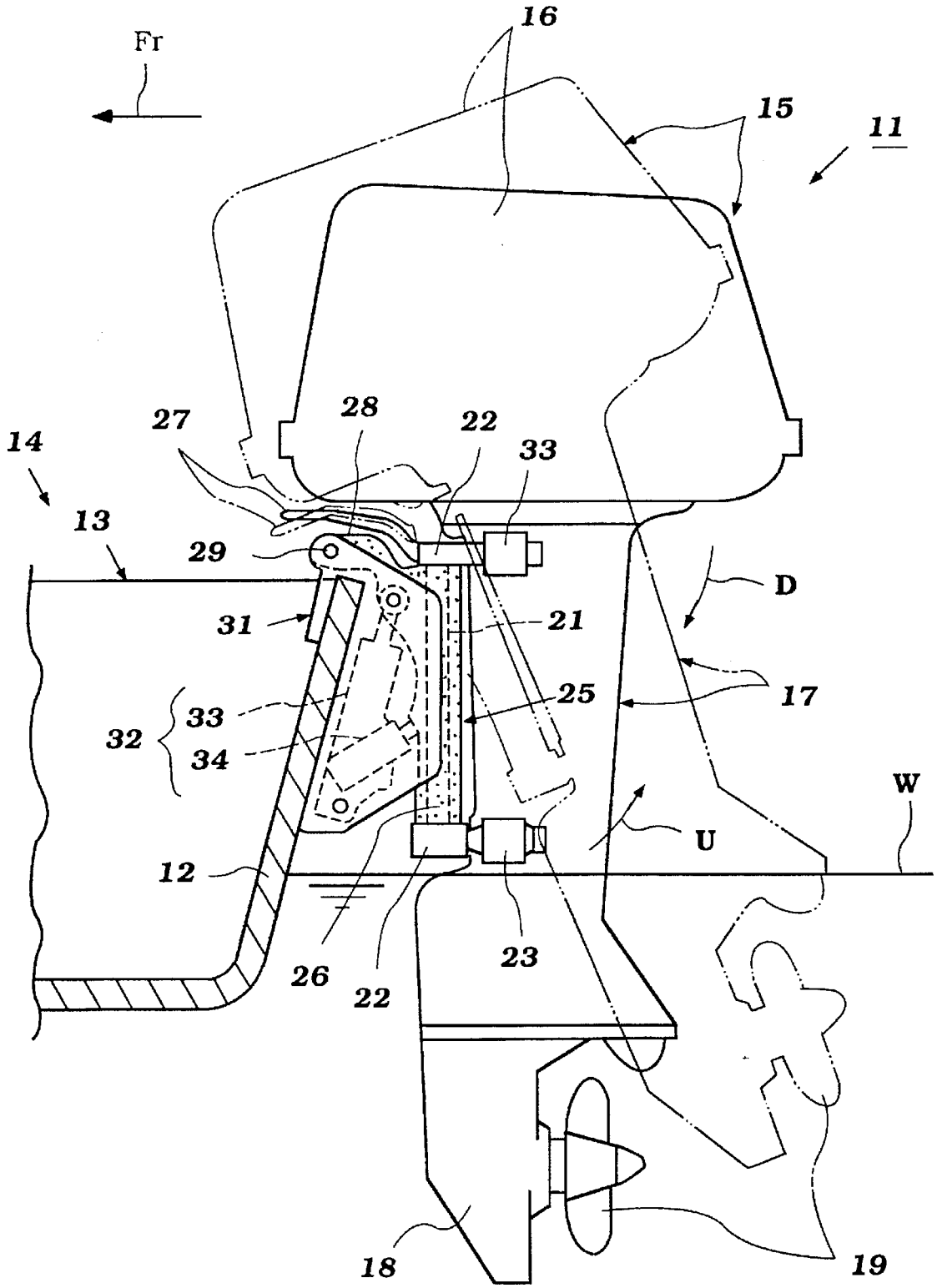
FIG. 1 is a side elevational view of a marine outboard drive attached to the transom of a watercraft, shown partially and in cross section. The outboard drive is shown in a fully trimmed down position in solid lines and in a fully trimmed up position in phantom lines.
Figure 2:
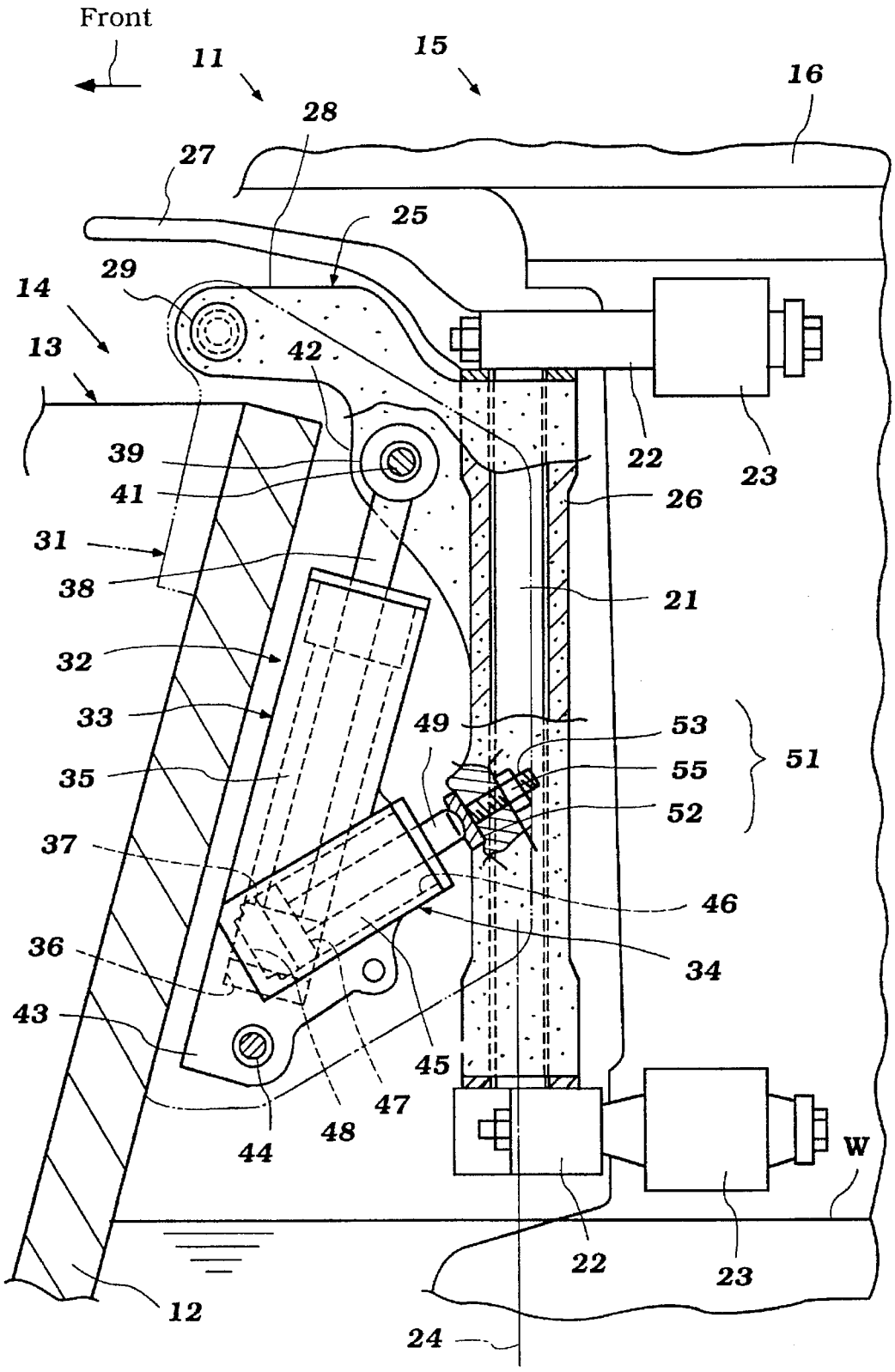
FIG. 2 is an enlarged side elevational view, with portions broken away and shown in section, of the trim support for the outboard drive and the hydraulic tilt and trim mechanism interposed between the hull and the outboard drive.

Referring now in detail to the drawings, and initially to FIGS. 1 and 2, a marine outboard drive in the form of an outboard motor is indicated generally by the reference numeral 11 and is shown as being attached in a conventional manner to a transom 12 of a hull 13 of a watercraft, indicated generally by the reference numeral 14. The invention is described in conjunction with an outboard motor 11, but it should be readily apparent to those skilled in the art how the invention can be practiced in conjunction with the outboard drive portion of an inboard/outboard drive. As previously noted, such outboard-mounted propulsion units are referred to generically as marine "outboard drives".

Although the actual construction of the outboard motor 11 forms no part of the invention, it is comprised generally of a power head 15 containing a powering internal combustion engine of any known type (not shown) that is contained within a protective cowling 16.

As is typical with outboard motor practice, the engine of the power head 15 is supported so that its output shaft rotates about a vertically extending axis and drives a drive shaft (not shown) that depends through and is rotatably journalled within a drive shaft housing 17 positioned at the lower end of the power head 15. This drive shaft continues on to a lower unit 18 in which a propulsion device 19 is mounted and driven for propelling the watercraft 14. In the illustrated embodiment, the propulsion device 19 comprises a propeller, but it should be readily apparent to those skilled in the art how the invention can be practiced with other types of marine propulsion units which require trim adjustment.

A steering shaft 21 is connected to the drive shaft housing 17 by means of upper and lower bracket assemblies 22 which are in turn, connected to the drive shaft housing 17 by elastic isolators 23. These elastic isolators 23 permit some relative movement and contain a damping mechanism for damping the forces transmitted between the steering shaft 21 and the drive shaft housing 17.

This steering shaft 21 is rotatably journalled for steering movement about a steering axis 24 (FIG. 2) within a swivel bracket assembly, indicated generally by the reference numeral 25. The swivel bracket assembly 25 is comprised of a cylindrical portion 26 in which the steering shaft 21 is journalled for steering movement about the steering axis 24. A tiller 27 is affixed to the upper end of the steering shaft 21 for effecting steering of the outboard motor 11, and specifically the power head 16, drive shaft housing 17, lower unit 18, and propulsion device 19, in a well-known manner.

The swivel bracket 25 has a forwardly extending portion 28 that is connected by means of a pivot pin 29 to a clamping bracket 31. The clamping bracket 31 is affixed in a well-known manner to the transom 12 so that the outboard motor 11 may pivot about an axis defined by the pivot pin 29 between a plurality of trim adjusted positions, the lowermost of which is shown in solid lines in FIG. 1 and the uppermost of which is shown in phantom lines, in the directions indicated by the arrows U and D, respectively. In addition, this pivotal connection permits the outboard motor 11 to be tilted up to and out of the water condition for storage or transport, as is also well known in this art.

A hydraulically operated tilt and trim assembly, indicated generally by the reference numeral 32 and which embodies the invention, is interposed between the outboard motor 11 and the hull 13 of the watercraft 14 for effecting this tilt and trim movement. The construction of the outboard motor as thus far described may be considered to be conventional, and therefore, reference may be had to any conventional structure for the details of the components which have already been described.

The hydraulic tilt and trim mechanism 32 includes a hydraulic tilt fluid motor 33 which may, as is conventional in this art, also include a hydraulic shock-absorbing mechanism for resisting popping up of the outboard motor 11 about the trim axis defined by the pin 29 during reverse thrust operation. This mechanism permit the outboard motor to pop up when an underwater obstacle is struck, and when that obstacle is cleared to return to the trim adjusted position. The trim adjustment is controlled by a hydraulic trim fluid motor 34 and which embodies the invention. The hydraulic tilt and trim mechanism 32 is controlled by an appropriate hydraulic circuit, and since any conventional type of circuit may be employed and since the circuit for actuating the hydraulic motors 33 and 34 forms no part of the invention, it will not be described in detail.

Referring now primarily to FIG. 2, the hydraulic tilt fluid motor 33 is comprised of an outer cylinder 35 which defines a cylinder bore 36 in which a piston 37 is slidably received so as to define an upper fluid chamber and a lower fluid chamber. A piston rod 38 is affixed to the piston 37 and extends upwardly through the upper fluid chamber and terminates in a trunnion 39 which is connected by means of a pivot pin 41 to a lug 42 of the swivel bracket 25.

The cylinder assembly 35 itself is provided with a lug or trunnion 43 that is pivotally connected to the clamping bracket 31, and specifically a pair of side arms thereof, by a pivot pin 44.

As is well known in this art, when the portion of the cylinder bore 36 below the piston 37 is pressurized and the upper chamber depressurized, the piston 37 will move upwardly and exert a force through the piston rod 38 on the swivel bracket 25 so as to tilt up the outboard motor 11. Tilt down is accomplished in the reverse direction. In addition and as has been noted, a hydraulic shock-absorbing arrangement of any conventional type may be contained within the tilt fluid motor 33 for accommodating popping up action, as aforedescribed. Again, since this construction may be conventional and forms no part of the invention, further description of it is not believed to be necessary to enable those skilled in the art to practice the invention.

The construction of the trim fluid motor 34, which does embody the invention, will now be described initially by reference to FIG. 2. This fluid motor includes an outer cylinder 45 that is affixed to the clamping bracket 31 in any well-known manner and which defines an internal cylinder bore 46. A piston 47 is slidably supported within the cylinder bore 46 and defines a fluid chamber 48 between a blind end of the cylinder bore 46 and the lower end of the piston 47. This chamber is selectively pressurized or depressurized so as to urge a piston rod 49, which extends through the remaining chamber of the trim fluid motor 34 in which there is no fluid, into engagement with the contact arrangement, indicated generally by the reference numeral 51, and fixed to the swivel bracket 25. This contact arrangement 51 includes a bearing plate 52 that is engaged with the end of the piston rod 49 and is carried by an adjustable screw 53 that extends through a further lug 54 of the swivel bracket 25. A nut 55 is threaded onto the screw 53 for locking the mechanism in its adjusted position.

It should be readily apparent that since all forward driving forces are transmitted through the trim fluid motor 34 from the contact between the bearing block 52 and the piston 49 that wear in this area is a potential problem. This construction permits the bearing block 52 to be adjusted or replaced in the event it is worn. In addition, the trim fluid motor 34 is provided with a damping mechanism that limits internal wear and protects the system, as will be now described by reference to FIGS. 3–5.

Figure 3:
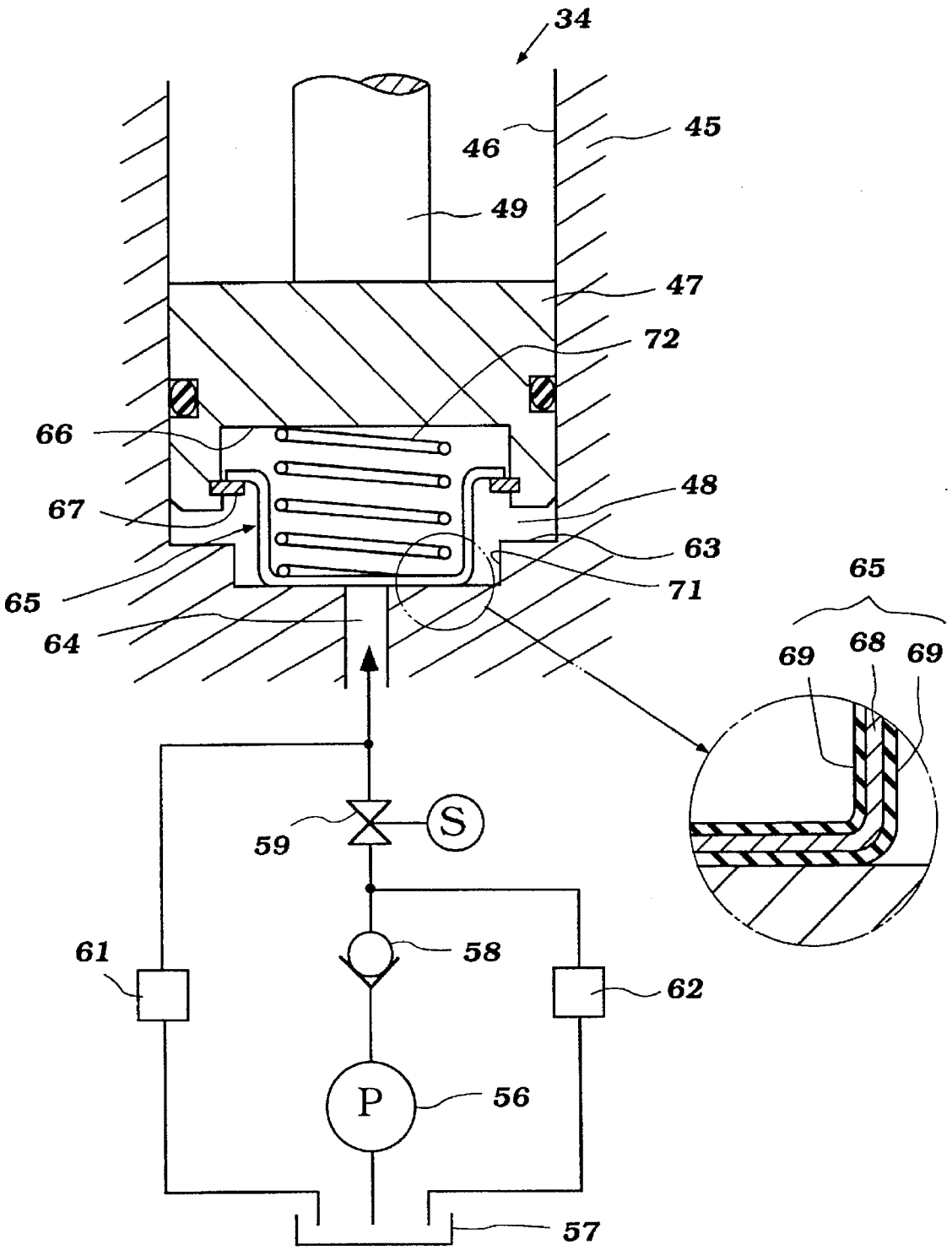
FIG. 3 is an enlarged cross-sectional view taken through the bottom of the trim cylinder and a combined schematic view showing the hydraulic system for effecting trim adjustment, with a portion of the cylinder mechanism being shown in an enlarged view.

FIG. 3 shows schematically the system for selectively pressurizing the trim fluid motor 34, and this includes an electrically operated pump 56 that draws hydraulic fluid from a reservoir 57 and delivers it through a conduit 58 to an operator-selected valve 59 which is opened when trim up or down adjustment is required. When so opened, the fluid pressure exerted on the piston 47 is controlled by a pressure relief valve 61. On the other hand, if trimmed down adjustment is required, the valve 59 is opened, and the pump 56 is de-energized so that pressure can be bled from the chamber 48 under the driving force of the outboard motor 11 through a pressure down valve 62. The hydraulic system thus far described supplies pressure to the chamber 48 between the piston 47 and the blind end 63 of the cylinder 45 through a pressure supply port 64. The construction as thus far described may be considered to be conventional.

In accordance with the invention, a position-responsive control valve assembly, indicated generally by the reference numeral 65, is provided that cooperates between the piston 47 and housing 45 to establish a fluid lock in the chamber 48 which provides hydraulic damping to downward movement that would cause the piston 47 to engage the blind end 63 of the cylinder and also which is operative to cushion any engagement which may in fact occur.

The lower end of the piston 47 is provided with a recess 66 in which the valve 65 is contained and held by a snap ring 67. The valve 65, as best seen in the enlarged view of FIG. 3, is comprised of a metal cup-shaped element 68 that has its inner and outer surfaces coated with an elastic resinous material, indicated at 69. This material 69 on the outer surface of the valve element 65 cooperates with a recessed portion 71 formed in the end wall 63 so as to open and close the port 64, as will become apparent. Finally, a coil compression spring 72 is loaded between the piston 47 and the valve element 65 to normally maintain the valve element 65 in engagement with the snap ring 67.

Figure 4:
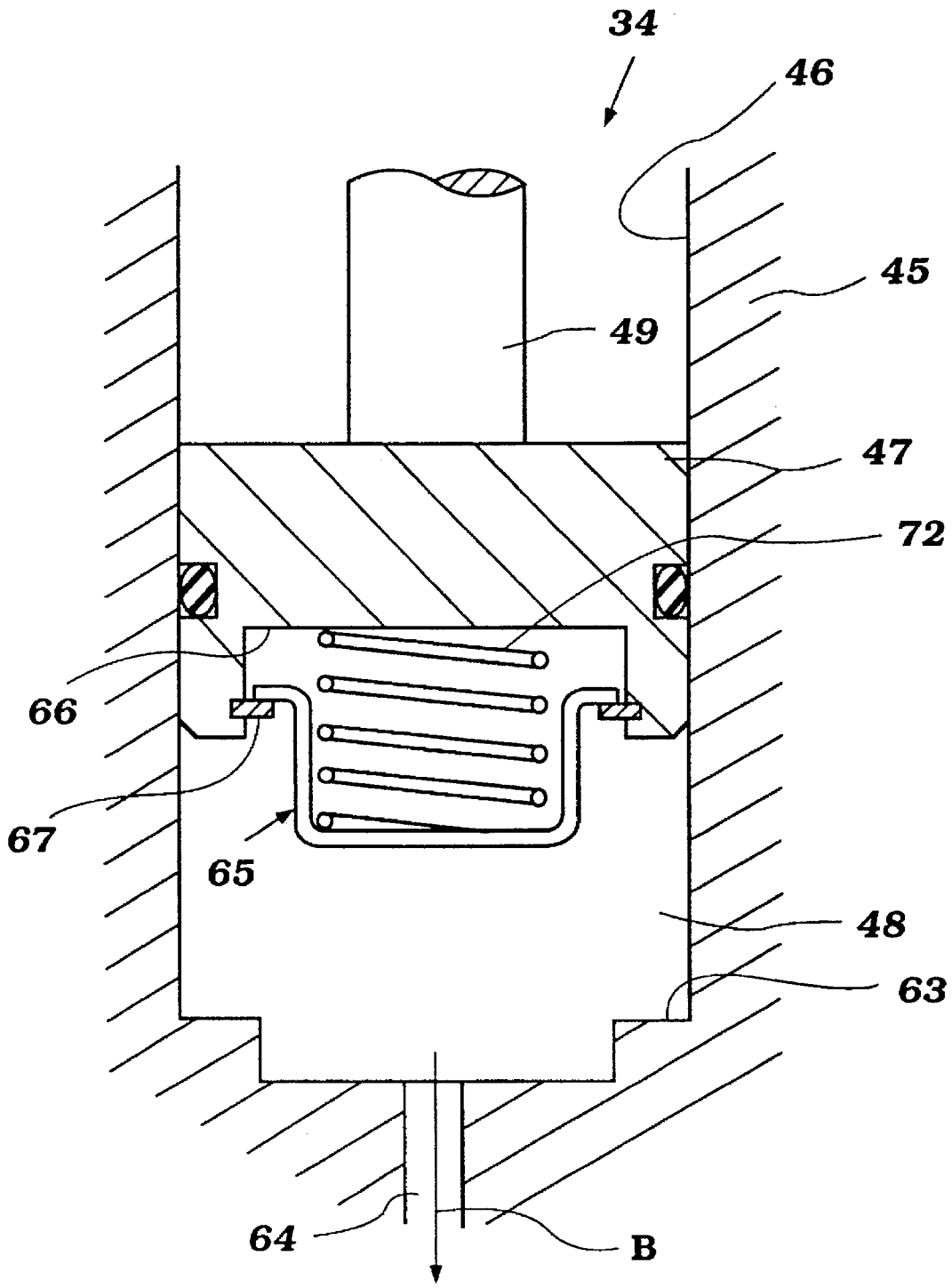
FIG. 4 is a cross-sectional view, in part similar to FIG. 3, and shows trimming down from the fully trimmed up condition.
Figure 5:
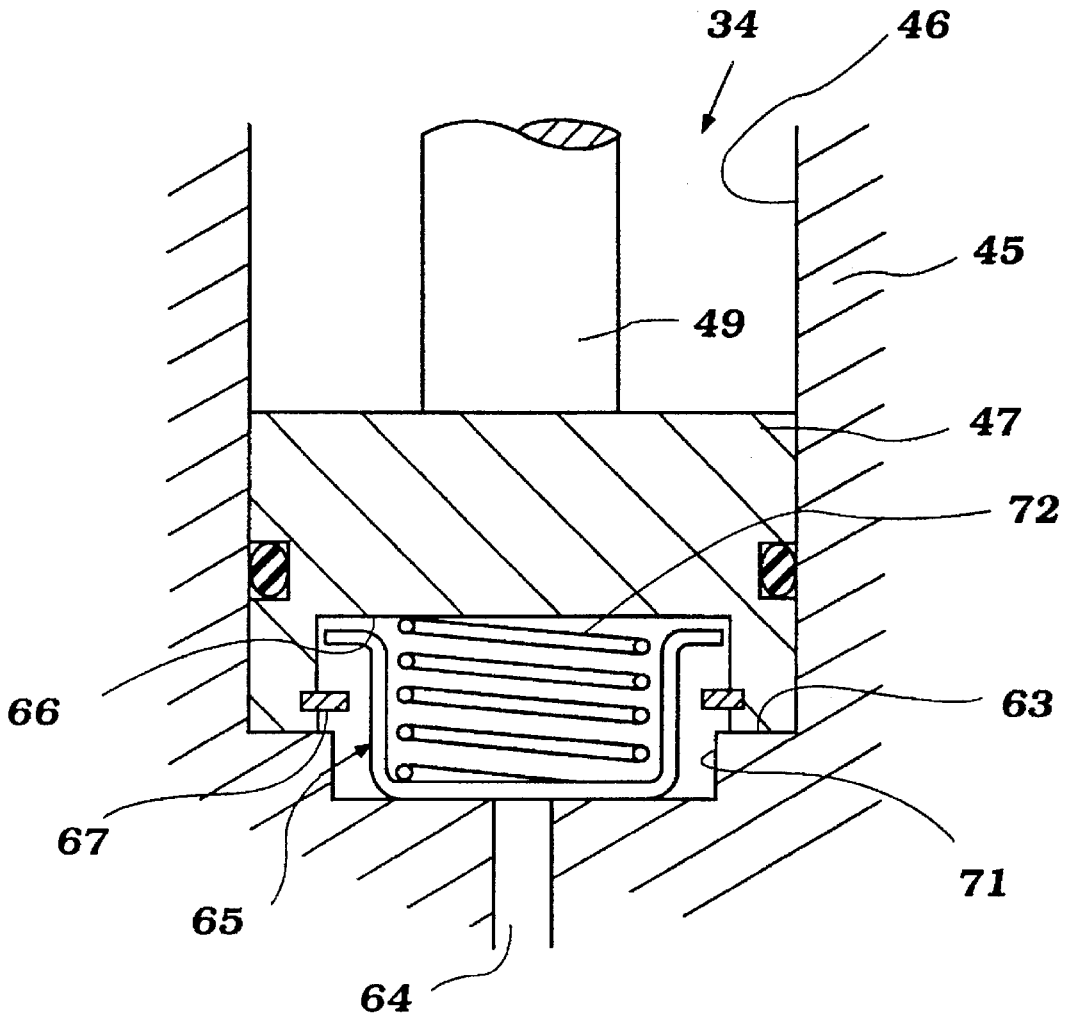
FIG. 5 is a cross-sectional view, in part similar to FIGS. 3 and 4, and shows the fully trimmed down condition.

FIG. 4 shows the construction of the unit when trimming down from a trim-up adjusted position. It should be noted that in this position the valve element 65 is spaced from the port 64, and during trim-down movement the piston 47 may move freely downwardly when the port 64 is to the reservoir 57. However, upon continued movement, the valve element 65 will eventually engage the wall portion in the depressed area 71, as shown in FIG. 5, and close off the port 64. This is the normal trimmed down position. If forces are exerted on the outboard motor in this direction, the spring 72 and the hydraulic lock in the chamber 48 will tend to resist any further downward movement, and will thus prevent metal-to-metal contact. If sufficient force is encountered, of course, then the piston 47 can contact the end wall 63 as shown in FIG. 5, but this contact will be well dampened, as should be readily apparent.

From the foregoing description it should be readily apparent that the described construction provides a very effective trim adjustment mechanism wherein metal-to-metal contact is substantially reduced and/or dampened. Of course, the foregoing description is that of a preferred embodiment of the invention, and various changes and modifications may be made without departing from the spirit and scope of the invention as defined by the appended claims.

I claim:

1. A hydraulic trim adjustment mechanism for a marine outboard drive having a propulsion unit and mounted on a watercraft hull for movement relative to said hull through a plurality of trim-adjusted positions for adjusting the trim of said propulsion unit relative to said hull, a hydraulic trim motor interposed between said propulsion unit and said hull for effecting hydraulic trim adjustment, said hydraulic trim motor comprising a cylinder member adapted to be affixed relative to said hull and defining blind cylinder bore closed by an end wall adjacent the hull and having an open end facing the propulsion unit, a piston received in said cylinder bore and defining a fluid chamber with said end wall, a piston rod affixed to said piston and extending through said open end to a location for engaging the propulsion unit for effecting trim movement of the propulsion unit upon the pressurization of said fluid chamber, a hydraulic system for selectively pressurizing and depressurizing said fluid chamber for effecting trim adjustment, and position-responsive valve means cooperating between said end wall and said piston for isolating said chamber from said hydraulic system when said components are in a trimmed down condition for establishing a fluid lock within said fluid chamber for hydraulic damping of engagement between said components comprising a port formed in said end wall through which said hydraulic system communicates with said fluid chamber, a valve element resiliently supported by said piston for engagement with said port for closing said port upon movement of said piston toward said end wall to a first relative position for establishing a fluid lock within said fluid chamber for hydraulically resisting continued movement of said piston toward said end wall, said valve element being yieldably biased relative to said piston for permitting continued movement of said piston toward said end wall after said valve element closes said port and the fluid in said fluid chamber is compressed, said piston and said end wall having positively engaging stop means for effecting a positive stop upon continued movement of said piston toward said end wall.

2. A hydraulic trim adjustment mechanism as set forth in claim 1, wherein the valve element is coated with a material for assisting in sealing thereof.

3. A hydraulic trim adjustment mechanism as set forth in claim 1, wherein the piston is formed with a bore adjacent the end wall of the cylinder and wherein the valve element comprises a cup-shaped member received in the piston bore and retained therein by a snap ring.

4. A hydraulic trim adjustment mechanism as set forth in claim 3, wherein the valve element biasing means comprises a coil compression spring interposed between the piston and the base of the cup-shaped portion of the valve element.

5. A hydraulic trim adjustment mechanism as set forth in claim 4 wherein the valve element is coated with a resilient material for effecting sealing with the port.

* * * * *